US008201343B2

(12) United States Patent
Morris

(10) Patent No.: US 8,201,343 B2
(45) Date of Patent: Jun. 19, 2012

(54) SAFETY STUD SETTER

(76) Inventor: Ronald Morris, Hickory, KY (US)

( * ) Notice: Subject to any disclaimer, the term of this patent is extended or adjusted under 35 U.S.C. 154(b) by 251 days.

(21) Appl. No.: 12/368,456

(22) Filed: Feb. 10, 2009

(65) Prior Publication Data

US 2010/0199595 A1 Aug. 12, 2010

(51) Int. Cl.
*G01B 3/30* (2006.01)

(52) U.S. Cl. ..... 33/613

(58) Field of Classification Search ..... 33/613
See application file for complete search history.

(56) References Cited

U.S. PATENT DOCUMENTS 3,083,007 A * 3/1963 Campfield ..... 269/151
3,456,702 A * 7/1969 Johnson ..... 269/41
4,322,064 A * 3/1982 Jarvis ..... 269/43
4,479,639 A * 10/1984 Kane ..... 269/6
5,826,858 A * 10/1998 Gordon ..... 254/17
5,937,531 A * 8/1999 Menk et al. ..... 33/613
2006/0260219 A1 * 11/2006 Riddle et al. ..... 52/127.2

* cited by examiner

*Primary Examiner* — Christopher W Fulton
(74) *Attorney, Agent, or Firm* — Mark Manley

(57) ABSTRACT

A safety stud setter includes a spacer bar along with a stud flange disposed at one end of the spacer bar for abutting a first stud disposed at a right angle to a transverse stud. A stud gripper is disposed at another end of a spacer bar for positioning a second stud disposed at a right angle to the transverse stud at a preselected distance from the stud and a lever mechanism is provided for forcing the second stud against the stud base to enable nailing of the second stud to the transverse stud through the stud base without movement of the second stud from the transverse stud. Safety guides are provided for positioning a nail gun head against the stud base and preventing escape of fired nails.

18 Claims, 3 Drawing Sheets

24
38
56
36
18
14
80
26
98
50
66
76
94
42
54
78
10
118
4
46
110
108
102
90
40
20
8
84
114

SAFETY STUD SETTER

The present invention generally relates to framing and is more particularly direct to a device for enabling square and precisely spaced apart wall studs.

Stud members are generally joined when the studs in a horizontal position to form a frame. Thereafter, assembled stud frames are erected, anchored, and connected to already standing frame sections.

However, proper spacing of the studs at four foot and eight foot intervals is very important in order that edges of coverings, such as sheet rock panels, can be attached to the studs.

The present invention provides for a stud setter for not only providing precise alignment of studs from one another, but facilitating nailing of the studs to a stud base without a hammer, when used, mispositioning the stud.

Nail guns are now used by most professionals and many do-it-yourselfers as well.

The biggest advantage of nail guns is their ability to rapidly fire a fastener into the substrate and to do so repeatedly. In high speed applications like framing and roofing nails, the nail guns are usually set to fire a nail anytime the muzzle makes contact with the surface as long as the trigger is pulled. They can fire rapidly almost like an automatic weapon.

Uncontrolled or misdirected firing of a nail gun is obviously dangerous. The present invention enables safe use of a nail gun by properly positioning the nail gun and preventing fired nails from injuring a user.

SUMMARY OF THE INVENTION

A stud setter in accordance with the present invention generally includes a spacer bar with a stud flange disposed at one end of the spacer bar and extending therefrom for abutting a first stud disposed at a right angle to a transverse stud (either a stud base plate, or stud top plate, or both). This facilitates assembly of the frame members while the frame is in a horizontal orientation. The stud flange may be hingeably attached to the spacer bar.

A stud gripper is disposed at another end of the spacer bar for positioning a second stud, also disposed at a right angle to the transverse stud at a preselected distance from the first stud. The preselected distance being determined by a length of the spacer bar.

In addition, a lever mechanism is provided for forcing the second stud against the transverse stud to enable nailing of the second stud to the transverse stud through the transverse stud without movement of the second stud from the transverse stud. In this manner, hammer blows do not misposition the skid from the position secured by the stud gripper.

The stud gripper includes an upstanding flange which is fixed to the spacer bar for enabling continued abutting relationship between the stud flange and the first stud during nailing of the second stud to the first stud. The positioning can be maintained by manual pressure against the upstanding flange.

Further, the lever mechanism comprises a top plate with a pair of depending spaced apart members, fixed on one side of the top plate, for engaging a bottom of the transverse stud. Spacing between the depending members enable nailing of the second stud through the transverse stud between the depending members while the second stud is forced against the transverse stud.

To facilitate the use of a nail gun a pair of safety guides extending outwardly from the depending members, are provided for guiding a nail gun head against the transverse stud and preventing escape of fired nails.

The lever mechanism may further include a pair of spaced apart guide plates fixed on an opposite side of the top plate and extending therefrom at an angle with respect thereto. The guide plates at the top plate are spaced apart for positioning the second stud against the transverse stud.

Still more particularly, the stud gripper includes a tongue winch extends from the top plate in a direction opposite to the one side of the top plate and a pair of spaced apart alms which are hingeably fixed to the tongue plate and disposed on opposite sides of the second stud for gripping the second stud.

The stud gripper further comprises a spring biased lever which fixed to the arms for wedging the arms against the second stud by forcing the arms between the glide plates and forcing the second stud against the transverse stud.

A method in accordance with the present invention generally includes disposing a stud flange, attached to one end of a spacer bar, against a first stud fixed to a transverse stud.

Thereafter, disposing a second stud between a pair of spaced apart aims attached to a stud gripper attached to an opposite end of the spacer bar. A lever is operated for gripping the second stud between the arms and forcing the second stud against the transverse stud base and thereafter the second stud is nailed to the stud base through the transverse stud base.

BRIEF DESCRIPTION OF THE DRAWINGS

The advantages and features of the present invention will be better understood by the following description when considered in conjunction with the accompanying drawings in which.

DETAILED DESCRIPTION

With reference to FIGS. 1-9, there is shown a stud setter 10 in accordance with the present invention which generally includes a spacer bar 14 along with a stud flange 18 disposed at one end 20 of the spacer bar 14.

Figures 1, 2, 8, 9:
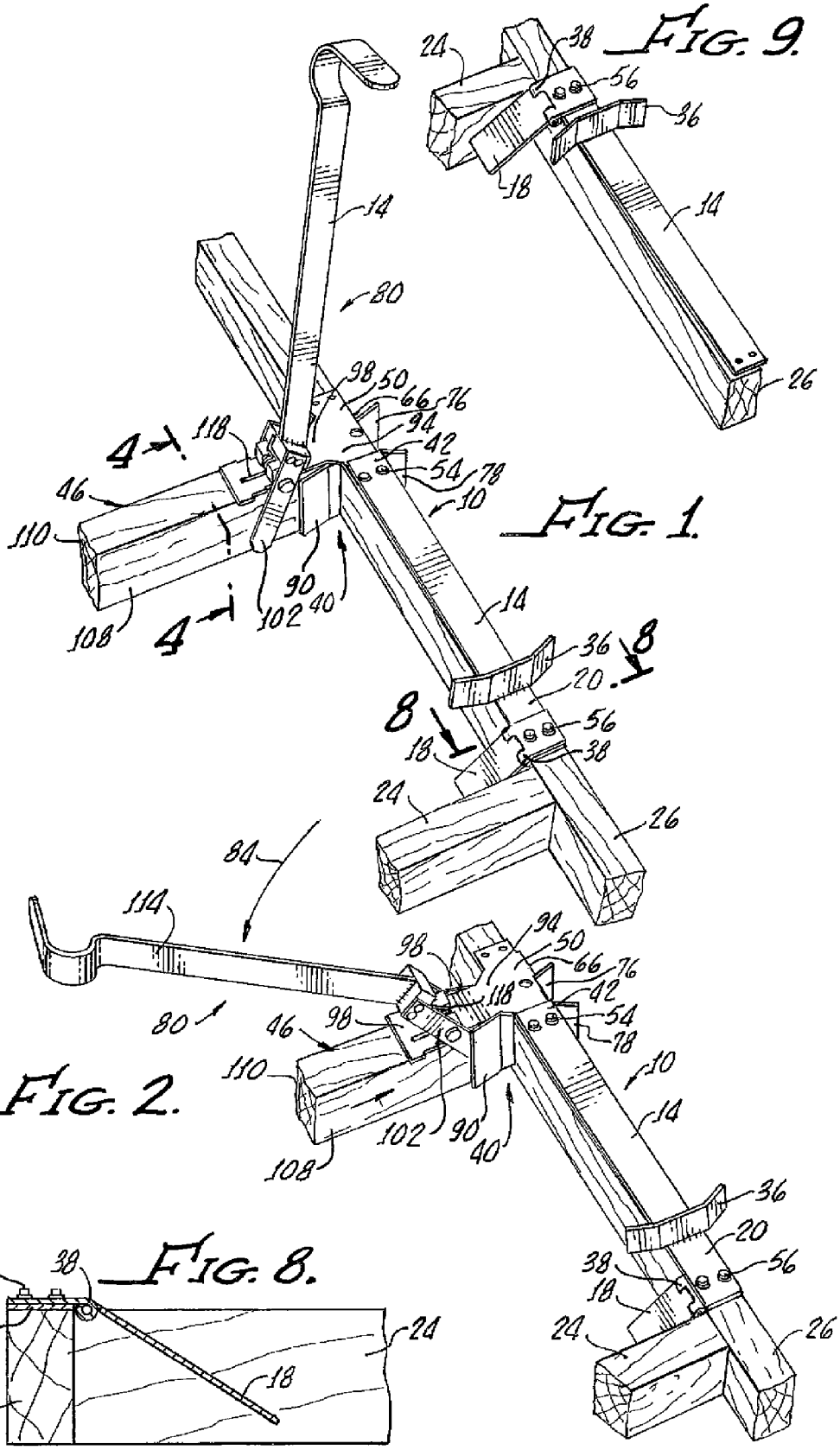
FIG. 1 is a perspective view of a stud setter in accordance with the present invention generally showing a spacer bar, a stud flange, disposed at one end of the spacer bar, and a stud gripper disposed at another end of the spacer bar for positioning a second stud disposed at a right angle to a transverse stud along with a lever mechanism for forcing the second stud against the transverse stud to enable nailing of the second stud to the transverse stud through the transverse stud without movement of the second stud from the transverse stud, the figure showing the second stud aligned between a pair of arms before being forced against the stud base.
FIG. 2 is a perspective view similar to that shown on FIG. 1 illustrating movement of the lever mechanism for forcing the second stud against the transverse stud, as operationally shown by arrows.
FIG. 8 is a view taken along a line 8-8 of FIG. 1 showing the stud flange being hingeably attached to the spacer bar.
FIG. 9 is a perspective view of the spacer bar with the stud flange being attached to an opposite end to illustrate the reversibly of the stud flange and stud gripper for facilitating use of the stud setter by a right or left hand user, the stud gripper not being shown for clarity.
Figure 3:
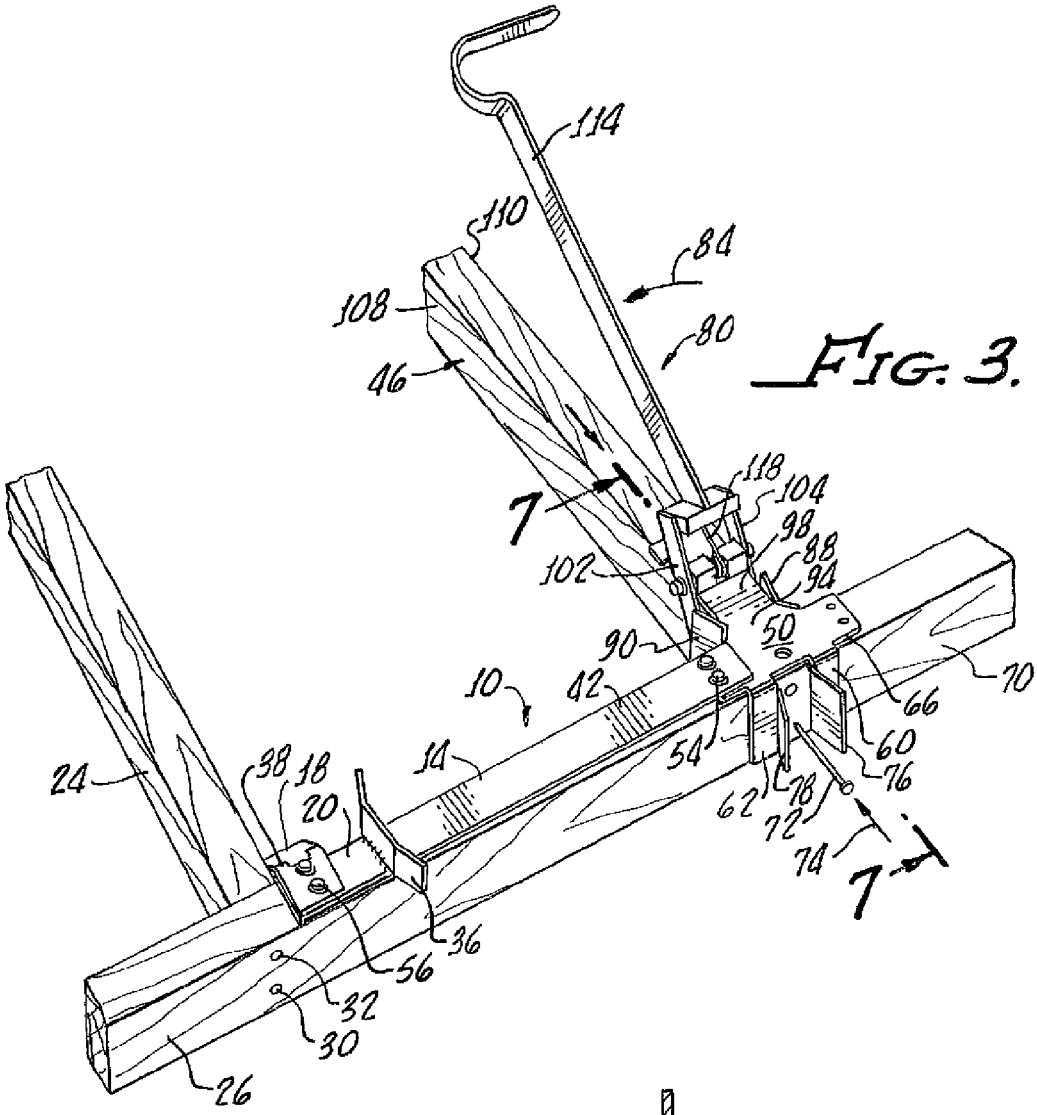
FIG. 3 is another perspective view of the present invention illustrating the nailing of the second stud to the transverse member between a pair of depending spaced apart members disposed on a bottom side of the transverse stud.

A first stud 24 has been fixed, as shown, in FIGS. 1-3 to a transverse stud 26 by nails 30, 32 and stud flange 18 maintains a continued abutting relationship with the first stud 24 by manually pushing against an upstanding flange 36 attached to the spacer bar 14. The stud flange 18 may be attached to the spacer bar 14 by a hinge 38 (see also FIG. 8).

A stud gripper 40 is disposed at another end 42, for positioning a second stud 46 at a right angle to the transverse stud 26 at a preselected distance from the first stud 24 as defined by a length of the spacer bar 14.

It should be appreciated that the stud flange 18 and stud gripper 40 which includes a top plate 50 may be fixed to the spacer bar 14 in any conventional manner. However, the spacer bars 14 may be attached to both the stud flange 18 and top plate 15 by bolts 54, 56. This arrangement enables spacer bars 14 of different lengths (not shown) to be utilized as may be desired for accommodating spacing requirement such as needed for joists (not shown) as opposed to wall studs 24, 46.

In addition, since the stud flange 18 and stud gripper 40 are removably attached to the spacer bar 14 by bolts 54, 56, they can be reversed as illustrated in FIG. 9 (only the stud flange 18 being shown) for facilitating use of the stud setter 10 by both right and left handed users (not shown).

With reference to FIG. 3, the lever mechanism top plate 50 includes a pair of depending spaced apart members 60, 62 affixed on one side 66 of the top plate 50 for engaging a bottom 70 of the transverse stud 26. As shown, the spacing between the depending members 60, 62 enables nailing of the second stud 46 through the transverse stud 26 as illustrated by a nail 72 and direction arrow 74.

Figure 7:
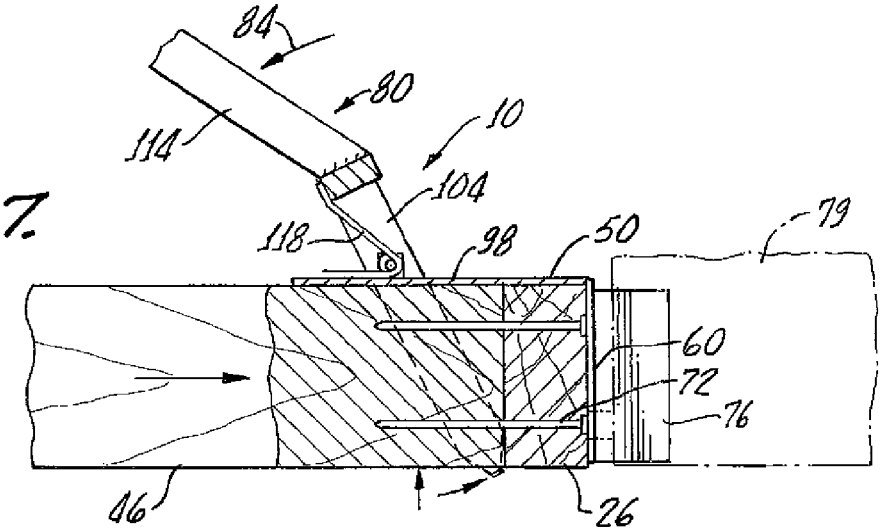
FIG. 7 is a cross sectional view taken along the line 7-7 of FIG. 3 illustrating a second stud nailed to a transverse stud by a nail gun.

A pair of safety guides 76, 78 extend from the members 60, 62 respectively for guiding a nail gun head 79, see FIG. 7, and also prevent escape of any fired nails from the stud gripper 40.

A lever mechanism 80 is provided in conjunction with the stud gripper 40 and is operative, as illustrated by the arrow 84 for enabling nailing of the second stud 46 to the transverse stud 26. The second stud is forced and held against the transverse stud 26 by the lever mechanism 80 which enables nailing of the second stud 46 through the transverse stud 26 without movement thereof of the second stud 46.

As more particularly shown in FIGS. 1-3, the lever mechanism 80 includes a pair of spaced apart guide plates 88, 90 fixed on an opposite side 94 of the top plate 50 and extending at an angle therefrom. The guide plates 88, 90 are spaced apart from another at the top plate 50 with a second stud 46 thickness for positioning the second stud 46 against the transverse stud 26.

Figure 4:
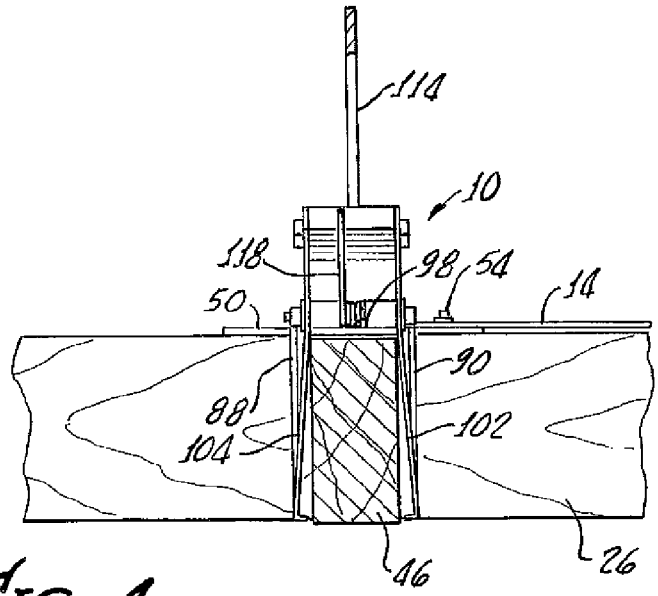
FIG. 4-4 is a cross sectional view taken along the line 4-4 in FIG. 1.
Figure 5:
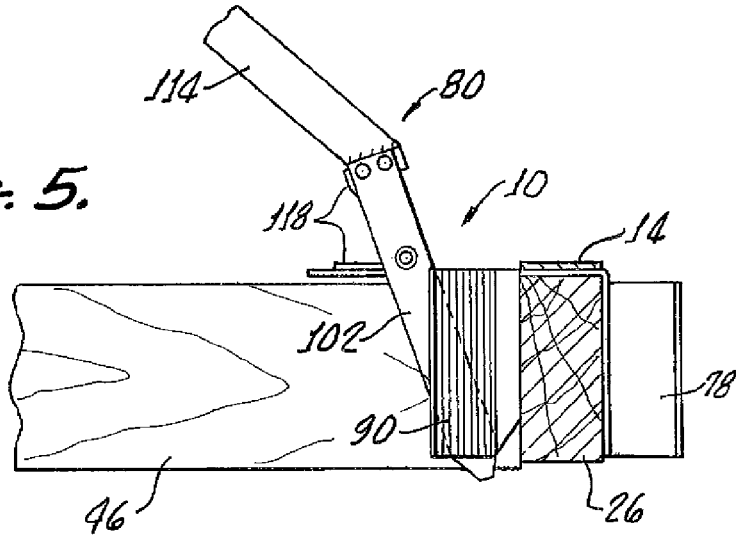
FIGS. 5-6 illustrate operation of the lever mechanism.
Figure 6:
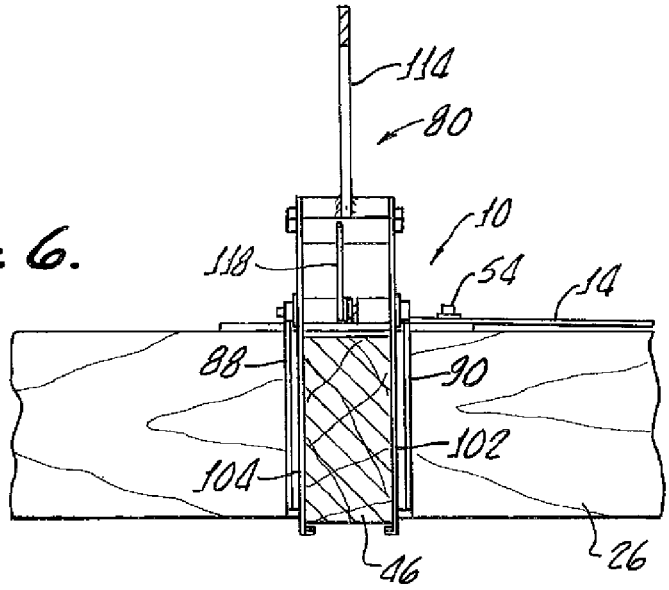

The stud gripper 40 further includes a tongue 98 extending from the top plate 50, see FIG. 4, as well as FIGS. 1-3. Arms 102, 104 are disposed on opposite sides 108, 110 of the second stud 46 for gripping of the second stud 46 as shown in FIGS. 1-3.

The lever mechanism 80 includes a lever 114 fixed to the alms 102, 104 for wedging the arms 102, 104 against the second stud 46 by forcing the arms between the guide plates 88, 90 as shown in FIGS. 1-7. The lever 114 is biased by a spring 118 to return the lever 114 to an upright position as shown in FIG. 1 after depression as shown in FIG. 2.

It follows that a method for setting studs in accordance with the present invention includes disposing a stud flange 18 attached to one end of a spacer bar 14 against a first stud 24 fixed to a transverse stud 26 and thereafter disposing a second stud 46 between a pair of spaced apart arms 102, 104 attached to a stud gripper 40 fixed to an opposite end of the spacer bar 14.

A lever mechanism is operated for gripping the second stud 46 between the alms 102, 104 and forcing the second stud 46 against the transverse stud 26 and thereafter the second stud 46 is nailed to the transverse stud 26 through the transverse stud 26.

Although there has been hereinabove described a stud setter in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A stud setter comprising:

a spacer bar;

a stud flange disposed at one end of said spacer bar and extending therefrom for abutting a first stud disposed at a right angle to a transverse stud;

a stud gripper disposed at another end of said spacer bar for positioning a second stud, disposed at a right angle to the traverse stud, at a preselected distance from said first stud, said stud gripper comprising a top plate with a pair of depending spaced apart members, fixed on one side of said top plate, for engaging the traverse stud, spacing between the depending members enabling nailing of said second stud through the transverse stud between the depending members; and a lever mechanism, attached to said stud gripper for forcing said second stud against the transverse stud to enable nailing of said second stud to the transverse stud through the transverse stud without movement of said second stud from the transverse stud, said lever mechanism further comprising a pair of spared apart guide plates fixed to an opposite side of said top plate and extending therefrom at an angle with respect thereto, the guide plates being spaced apart from one another at the top plate at a stud thickness for positioning said second stud.

2. The stud setter according to claim 1 further comprising a pair of safety guides extending outwardly from the depending members for guiding a nail gun head against the transverse stud and preventing escape of fired nails.

3. The stud setter according to claim 2 wherein said stud gripper further comprising a tongue extending from said top plate in a direction opposite to the one side of said top plate.

4. The stud setter according to claim 3 wherein said lever mechanism further comprises a pair of spaced apart arms, hingeably fixed to said tongue and disposable on opposite sides of said second stud for gripping said second stud.

5. The stud setter according to claim 4 wherein said lever mechanism further comprises a lever fixed to the arms for wedging the arms against said second stud by forcing the arms between said guide plates.

6. The stud setter according to claim 5 further comprising a spring for biasing said lever in an upright position.

7. The stud setter according to claim 1 further comprising an upstanding flange, fixed to said spacer bar, for enabling a continued abutting relationship between said stud flange and said first stud during nailing of said second stud to the traverse stud.

8. The stud setter according to claim 1 wherein said stud flange and said stud gripper are removably attached to said spacer bar for enabling end-to-end exchange for facilitating use of the stud setter by both right and left hand users.

9. The stud setter according to claim 1 wherein said stud flange is hingeably attached to said spacer bar.

10. A stud setter comprising:

a spacer bar;

a stud flange disposed at one end of said spacer bar and extending therefrom for abutting a first stud disposed at a right angle to a transverse stud;

a stud gripper disposed at another end of said spacer bar for positioning a second stud, disposed at a right angle to the transverse stud, at a preselected distance from said first stud, said stud gripper comprising a to plate with a pair of depending spaced apart members, fixed on one side of said to plate, for engaging the traverse stud, spacing between the depending members enabling nailing of said second stud through the transverse stud between the depending members;

a lever mechanism, attached to said stud gripper, for forcing said second stud against the transverse stud to enable nailing of said second stud to the transverse stud through the transverse stud without movement of said second stud from the transverse stud, said lever mechanism further comprising a pair of spaced apart guide plates fixed to said top plate and extending therefrom, the guide plates being spaced apart from one another at a stud thickness for positioning said second stud; and a pair of safety guides extending outwardly from the depending members for guiding a nail gun head against the transverse stud and preventing escape of fired nails.

11. The stud setter according to claim 10 wherein said stud gripper further comprising a tongue extending from said top plate in a direction opposite to the one side of said top plate.

12. The stud setter according to claim 11 wherein said lever mechanism further comprises a pair of spaced apart arms, hingeably fixed to said tongue and disposable on opposite sides of said second stud for gripping said second stud.

13. The stud setter according to claim 12 wherein said lever mechanism further comprises a lever fixed to the arms for wedging the arms against said second stud by forcing the arms between said guide plates.

14. The stud setter according to claim 13 further comprising a spring for biasing said lever in an upright position.

15. The stud setter according to claim 10 further comprising an upstanding flange, fixed to said spacer bar, for enabling a continued abutting relationship between said stud flange and said first stud during nailing of said second stud to the traverse stud.

16. The stud setter according to claim 10 wherein said stud flange is hingeably attached to said spacer bar.

17. The stud setter according to claim 10 wherein said stud flange and said stud gripper are removably attached to said spacer bar for enabling end-to-end exchange for facilitating use of the stud setter by both right and left hand users.

18. A method for setting studs comprising:

disposing a stud flange, attached to one end of a spacer bar, against a first stud fixed to a transverse stud;

disposing a second stud between a pair of spaced apart arms attached to a stud gripper attached to an opposite end of the spacer bar;

operating a lever mechanism, fixed to the spacer bar, for gripping said second stud between the arms and forcing said second stud against said transverse stud; and nailing said second stud to said transverse stud through said transverse stud.

* * * * *